US009394810B2

(12) United States Patent
Otsubo et al.

(10) Patent No.: US 9,394,810 B2
(45) Date of Patent: Jul. 19, 2016

(54) VALVE TIMING CONTROLLER

(71) Applicants: DENSO CORPORATION, Kariya, Aichi-pref. (JP); NIPPON SOKEN, INC., Nishio, Aichi-pref. (JP)

(72) Inventors: Makoto Otsubo, Okazaki (JP); Hiroki Takahashi, Okazaki (JP); Taei Sugiura, Anjo (JP)

(73) Assignees: DENSO CORPORATION, Kariya (JP); NIPPON SOKEN, INC., Nishio (JP)

( * ) Notice: Subject to any disclaimer, the term of this patent is extended or adjusted under 35 U.S.C. 154(b) by 0 days.

(21) Appl. No.: 14/796,191

(22) Filed: Jul. 10, 2015

(65) Prior Publication Data

US 2016/0017771 A1 Jan. 21, 2016

(30) Foreign Application Priority Data

Jul. 16, 2014 (JP) ..... 2014-146280

(51) Int. Cl.

| | |
|---|---|
| ***F01L 1/34*** | (2006.01) |
| ***F01L 1/352*** | (2006.01) |
| *F01L 1/344* | (2006.01) |

(52) U.S. Cl.

CPC ..... *F01L 1/352* (2013.01); *F01L 1/344* (2013.01); *F01L 2001/3521* (2013.01)

(58) Field of Classification Search

CPC .... F01L 1/344; F01L 1/352; F01L 2001/3521
USPC ..... 123/90.15, 90.17; 464/160
See application file for complete search history.

(56) References Cited

U.S. PATENT DOCUMENTS 8,985,075 B2 * 3/2015 Tadokoro ..... F01L 1/34 123/90.17
2009/0017952 A1 1/2009 Sugiura et al.

* cited by examiner

*Primary Examiner* — Ching Chang
(74) *Attorney, Agent, or Firm* — Nixon & Vanderhye PC

(57) ABSTRACT

In a definition cross-section of a planet gear located on an eccentric side in a radial direction relative to a driving rotor and a driven rotor, an imaginary straight line is defined by connecting a center of a planet side outer arc part that configures a raceway groove of a planet outer wheel on the eccentric side to a center of a solar side outer arc part that configures a raceway groove of a solar outer wheel on an opposite side opposite from the eccentric side. A planet side inner arc part of a planet inner wheel and a solar side inner arc part of a solar inner wheel are located on the imaginary straight line in the definition cross-section.

5 Claims, 5 Drawing Sheets

VALVE TIMING CONTROLLER

CROSS REFERENCE TO RELATED APPLICATION

This application is based on Japanese Patent Application No. 2014-146280 filed on Jul. 16, 2014, the disclosure of which is incorporated herein by reference in its entirety.

TECHNICAL FIELD

The present disclosure relates to a valve timing controller.

BACKGROUND

A valve timing controller controls a rotation phase of a driven rotor that rotates with a camshaft relative to a driving rotor that rotates with a crankshaft using planet movement of a planet gear.

JP 4360426 B (US 2009/0017952 A1) describes a valve timing controller in which a driving side planet external gear part and a driven side planet external gear part of a planet gear mesh with a driving side solar internal gear part of a driving rotor and a driven side solar internal gear part of a driven rotor, respectively, in the eccentric state. The valve timing controller is suitably mounted to an internal combustion engine, for example, in a narrow space of a vehicle, since a large reduction ratio can be obtained with the downsized structure.

In JP 4360426 B, the planet gear and the driving rotor are supported by a planet bearing and a solar bearing respectively from an inner side in the radial direction, and a planet carrier is supported by the planet bearing and the solar bearing from an outer side in the radial direction. The planet gear can smoothly have planet movement according to a relative rotation of the planet carrier relative to the driving side solar internal gear part of the driving rotor, so it is possible to improve the control responsivity of the valve timing according to the rotation phase.

In JP 4360426 B, an elastic component is interposed between the planet carrier and the planet bearing, thereby biasing the planet gear to the eccentric side through the planet bearing relative to the driving rotor and the driven rotor. Thus, abnormal noise and wear are restricted at an engagement portion between the driving side solar internal gear part and the driving side planet external gear part and an engagement portion between the driven side solar internal gear part and the driven side planet external gear part.

In JP 4360426 B, the planet bearing has double rows of spherical rolling elements interposed between an outer wheel that supports the planet gear from a radially inner side and an inner wheel that supports the planet carrier from a radially outer side. Moreover, the solar bearing similarly has double rows of spherical rolling elements interposed between an outer wheel that supports the driving rotor from a radially inner side and an inner wheel that supports the planet carrier from a radially outer side.

SUMMARY

It is an object of the present disclosure to provide a valve timing controller in which the durability is improved while the valve timing controller is downsized.

According to an aspect of the present disclosure, a valve timing controller that controls valve timing of a valve opened and closed by a camshaft by torque transferred from a crankshaft of an internal combustion engine includes a driving rotor, a driven rotor, a planet gear, a planet bearing, a solar bearing, a planet carrier, and an elastic component. The driving rotor rotates with the crankshaft, and has a driving side solar internal gear part. The driven rotor rotates with the camshaft, and has a driven side solar internal gear part that is located adjacent to the camshaft in an axial direction than the driving side solar internal gear part is. The planet gear is located on an eccentric side eccentric to the driving rotor and the driven rotor in a radial direction. The planet gear has a driving side planet external gear part meshing with the driving side solar internal gear part on the eccentric side, and a driven side planet external gear part meshing with the driven side solar internal gear part on the eccentric side at a location where the driven side planet external gear part is located adjacent to the camshaft than the driving side planet external gear part is. The driving side planet external gear part and the driven side planet external gear part of the planet gear integrally carry out planet movement to control a rotation phase of the driven rotor relative to the driving rotor. The planet bearing has a planet outer wheel that supports the planet gear from an inner side in the radial direction, a planet inner wheel located on an inner side of the planet outer wheel in the radial direction, and a single row of a plurality of planet spherical rolling elements between the planet outer wheel and the planet inner wheel. The solar bearing has a solar outer wheel that supports the driving rotor from an inner side in the radial direction, a solar inner wheel located on an inner side of the solar outer wheel in the radial direction, and a single row of a plurality of solar spherical rolling elements between the solar outer wheel and the solar inner wheel. The planet carrier is supported by the planet inner wheel and the solar inner wheel from an outer side in the radial direction and is rotated relative to the driving side solar internal gear part such that the planet gear carries out the planet movement. The elastic component is interposed between the planet inner wheel and the planet carrier to bias the planet gear to the eccentric side through the planet bearing and to bias the planet carrier on an opposite side opposite from the eccentric side. The planet gear is defined to have a definition cross-section perpendicular to the axial direction when the planet gear is located on the eccentric side in the radial direction relative to the driving rotor and the driven rotor. In the definition cross-section, the planet outer wheel has a planet side outer arc part that configures a raceway groove of the planet outer wheel on the eccentric side, the solar outer wheel has a solar side outer arc part that configures a raceway groove of the solar outer wheel on the opposite side opposite from the eccentric side, the planet inner wheel has a planet side inner arc part that configures a raceway groove of the planet inner wheel on the eccentric side, and the solar inner wheel has a solar side inner arc part that configures a raceway groove of the solar inner wheel on the opposite side opposite from the eccentric side. An imaginary straight line is defined by connecting a center of the planet side outer arc part and a center of the solar side outer arc part to each other. The planet side inner arc part and the solar side inner arc part are located on the imaginary straight line.

The elastic component interposed between the planet inner wheel and the planet carrier biases the planet gear to the eccentric side in the radial direction through the planet bearing, and biases the planet carrier to the opposite side opposite from the eccentric side. In the definition cross-section of the planet gear that is eccentric in the radial direction, the planet side inner arc part on the eccentric side and the solar side inner arc part on the opposite side are located on the imaginary straight line that connects the center of the planet side outer arc part on the eccentric side to the center of the solar side outer arc part on the opposite side.

Thus, in the planet bearing having the single row of rolling elements, the load caused by the elastic component concentrates on the interface where the planet spherical rolling element is in the rolling contact with the planet inner wheel at the eccentric side location or a location adjacent to the eccentric side location in the circumferential direction in the definition cross-section.

Similarly, in the solar bearing having the single row of rolling elements, the load caused by the elastic component concentrates at the contact part where the solar spherical rolling element is in the rolling contact with the solar inner wheel at the opposite side location or a location adjacent to the opposite side location in the circumferential direction in the definition cross-section.

Since the load is applied in the concentrated state along the imaginary straight line, the planet carrier can be supported in the stabilized state, and the contact surface pressure is limitedly generated at the location where the load is concentrated.

Therefore, the durability can be improved while the valve timing controller is downsized by adopting the planet bearing having the single row of rolling elements and the solar bearing having the single row of rolling elements.

Moreover, the planet side outer arc part and the solar side outer arc part are located on the imaginary straight line together with the planet side inner arc part and the solar side inner arc part.

Accordingly, in the planet bearing having the single row of rolling elements, the load caused by the elastic component concentrates on the interface where the planet spherical rolling element is in the rolling contact with each of the planet inner wheel and the planet outer wheel at the eccentric side location or a location adjacent to the eccentric side location in the circumferential direction in the definition cross-section.

Similarly, in the solar bearing having the single row of rolling elements, the load caused by the elastic component concentrates at the contact part where the solar spherical rolling elements is in the rolling contact with each of the solar inner wheel and the solar outer wheel at the opposite side location or a location adjacent to the opposite side location in the circumferential direction in the definition cross-section.

Since the load is applied in the concentrated state along the imaginary straight line, the planet carrier, the planet bearing and the solar bearing can be supported in the stabilized state, and the contact surface pressure is limitedly generated at the location where the load is concentrated. Accordingly, the durability can be further improved.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
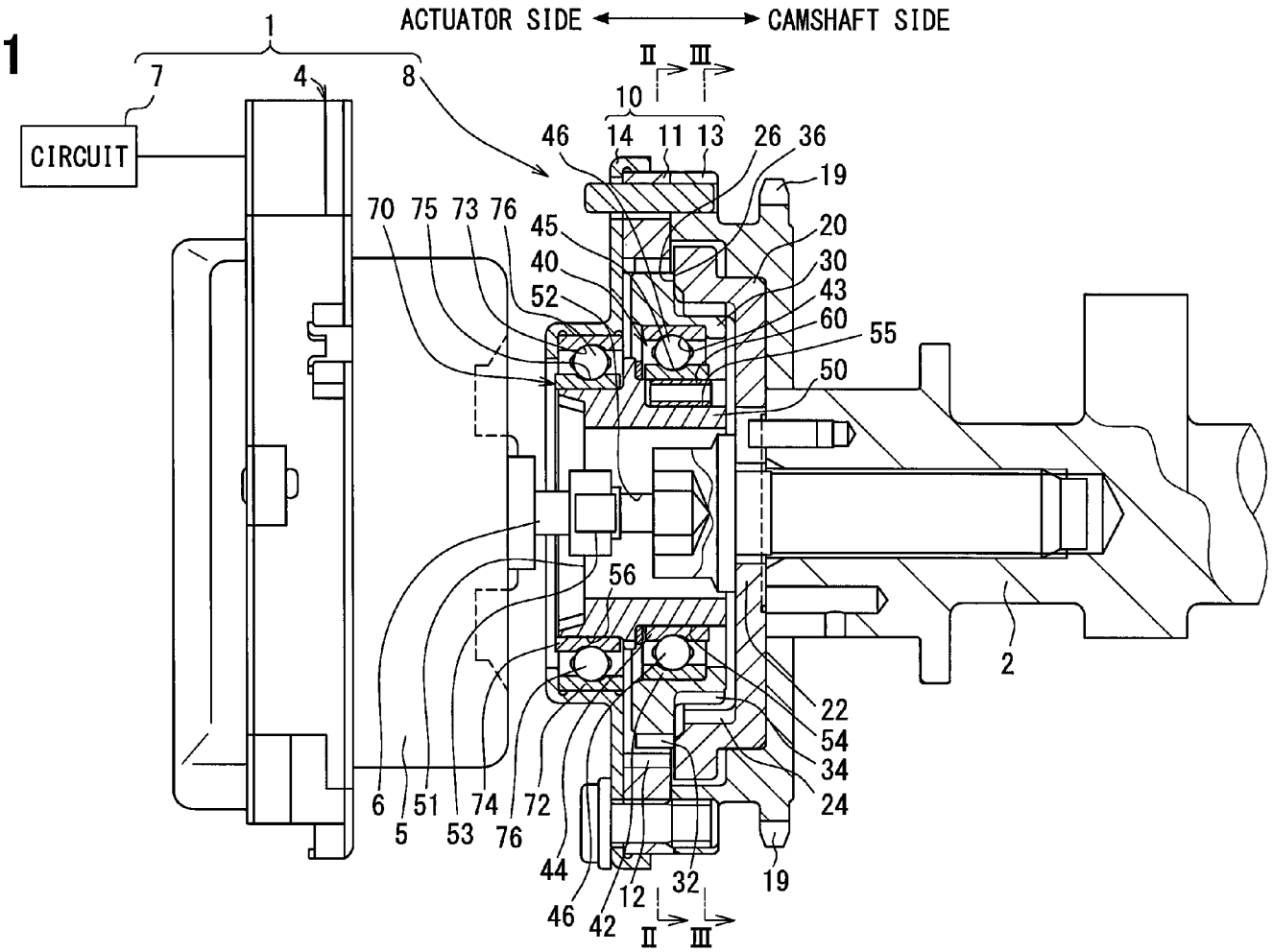
FIG. 1 is a schematic view illustrating a valve timing controller according to an embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

An embodiment is described based on drawings.

Figure 2:
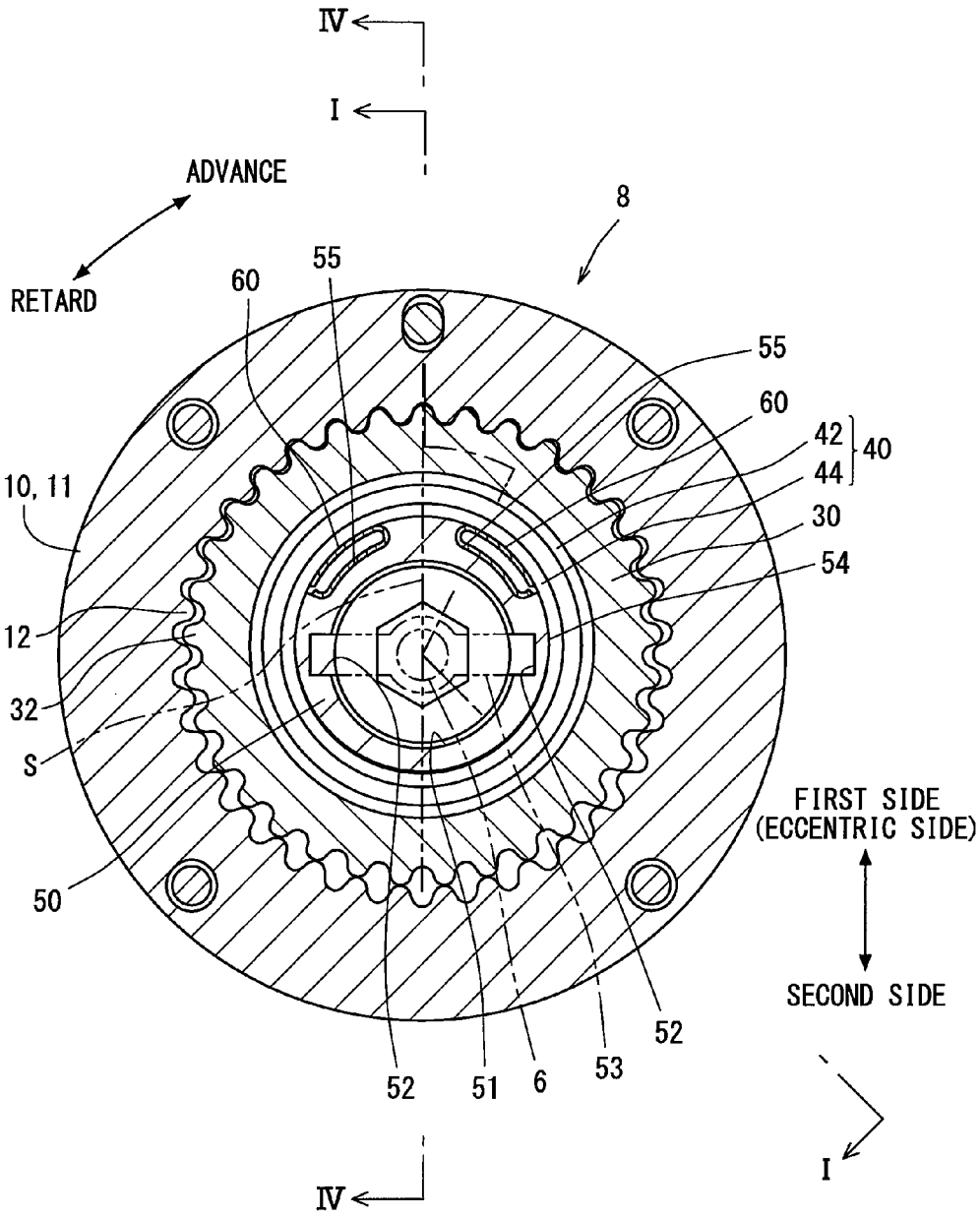
FIG. 2 is a cross-sectional view taken along a line II-II of FIG. 1.

As shown in FIG. 1 that includes a cross-sectional view taken along a line I-I of FIG. 2, a valve timing controller 1 according to the embodiment is attached to a power train system in which a crank torque is transmitted to a camshaft 2 from a crankshaft (not shown) in an internal combustion engine of a vehicle. The camshaft 2 opens and closes an intake valve (not shown) of the engine by the transmitted crank torque, such that the valve timing controller 1 controls the valve timing of the intake valve.

Figure 3:
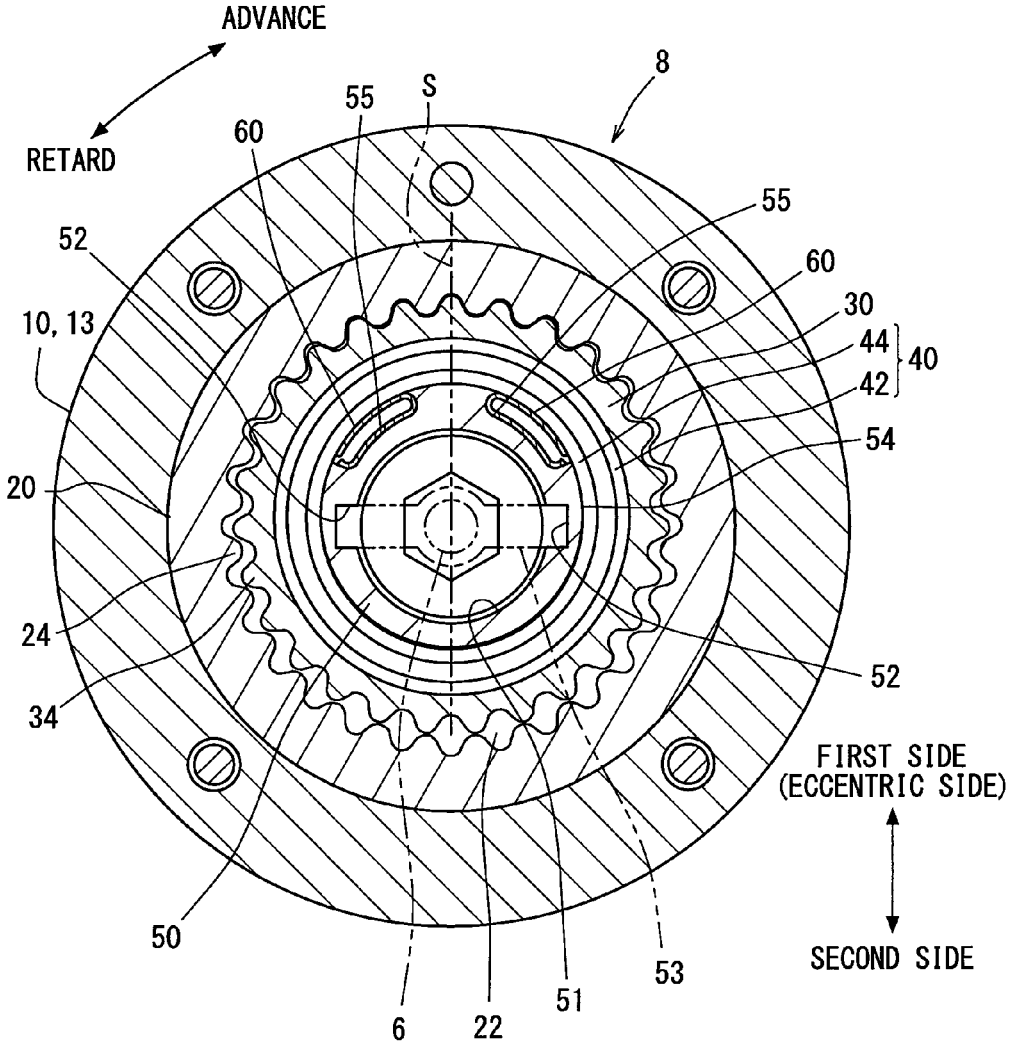
FIG. 3 is a cross-sectional view taken along a line III-III of FIG. 1.

As shown in FIGS. 1-3, the valve timing controller 1 includes an actuator 4, an energization control circuit unit 7, and a phase control unit 8.

The actuator 4 shown in FIG. 1 is an electric motor such as brushless motor, and has a housing body 5 and a control shaft 6. The housing body 5 is fixed to a fixed portion of the internal combustion engine, and supports the control shaft 6 in rotatable state. The energization control circuit unit 7 has a driver, and a microcomputer for controlling the driver. The energization control circuit unit 7 is arranged outside and/or inside the housing body 5. The energization control circuit unit 7 is electrically connected to the actuator 4 and controls the energization, such that the control shaft 6 is driven to rotate.

As shown in FIGS. 1-3, the phase control unit 8 includes a driving rotor 10, a driven rotor 20, a planet gear 30, a planet bearing 40, a solar bearing 70, a planet carrier 50, and an elastic component 60.

The driving rotor 10 is made of metal, and has a hollow structure. The driven rotor 20, the planet gear 30, the planet bearing 40, the planet carrier 50, and the elastic component 60 are arranged in the driving rotor 10. The driving rotor 10 has a sprocket component 13, a cover component 14 and a sun-gear component 11 interposed between the sprocket component 13 and the cover component 14. The sun-gear component 11 has a ring board shape. The sprocket component 13 has a based cylinder shape, and the cover component 14 has a stepped cylinder shape. The sun-gear component 11, the sprocket component 13 and the cover component 14 are tightened together.

As shown in FIGS. 1 and 2, the sun-gear component 11 has a driving side solar internal gear part 12 on the inner circumference surface of a peripheral wall part, and an addendum circle is located on the inner side of a root circle in the radial direction. As shown in FIG. 1, the sprocket component 13 has plural sprocket teeth 19 on the outer circumference surface of a peripheral wall part, and the sprocket teeth 19 are projected outward in the radial direction at positions arranged in a circumferential direction with a regular interval. A timing chain (not shown) is engaged with the sprocket teeth 19 and sprocket teeth of the crankshaft, such that the sprocket component 13 is coordinated with the crankshaft. When the crank torque outputted from the crankshaft is transmitted to the sprocket component 13 through the timing chain, the driving rotor 10 is rotated with the crankshaft in a fixed direction (clockwise in FIGS. 2 and 3).

As shown in FIGS. 1 and 3, the driven rotor 20 is arranged on the inner side of the sprocket component 13 in the radial direction. The driven rotor 20 is made of metal, and has a based cylinder shape. The driven rotor 20 is coaxially fitted into the sprocket component 13, thereby supporting the driving rotor 10 from the inner side in the radial direction. The driven rotor 20 is arranged between the sun-gear component 11 and the sprocket component 13 in the axial direction. The bottom wall part of the driven rotor 20 has a connection part 22 coaxially connected with the camshaft 2, such that the driven rotor 20 is supported by the camshaft 2 on one side. The driven rotor 20 is rotated in the same direction (clockwise in FIG. 3) as the driving rotor 10, and is able to rotate relative to the driving rotor 10.

The driven rotor 20 has a driven side solar internal gear part 24 on the inner circumference surface of a peripheral wall part, and an addendum circle is located on the inner side of a root circle in the radial direction. The driven side solar internal gear part 24 is arranged between the driving side solar internal gear part 12 and the camshaft 2 in the axial direction, and is located at a position not overlapping with the driving side solar internal gear part 12 in the radial direction. The inside diameter of the driven side solar internal gear part 24 is set smaller than the inside diameter of the driving side solar internal gear part 12. The number of teeth of the driven side solar internal gear part 24 is set less than the number of teeth of the driving side solar internal gear part 12.

Figure 4:
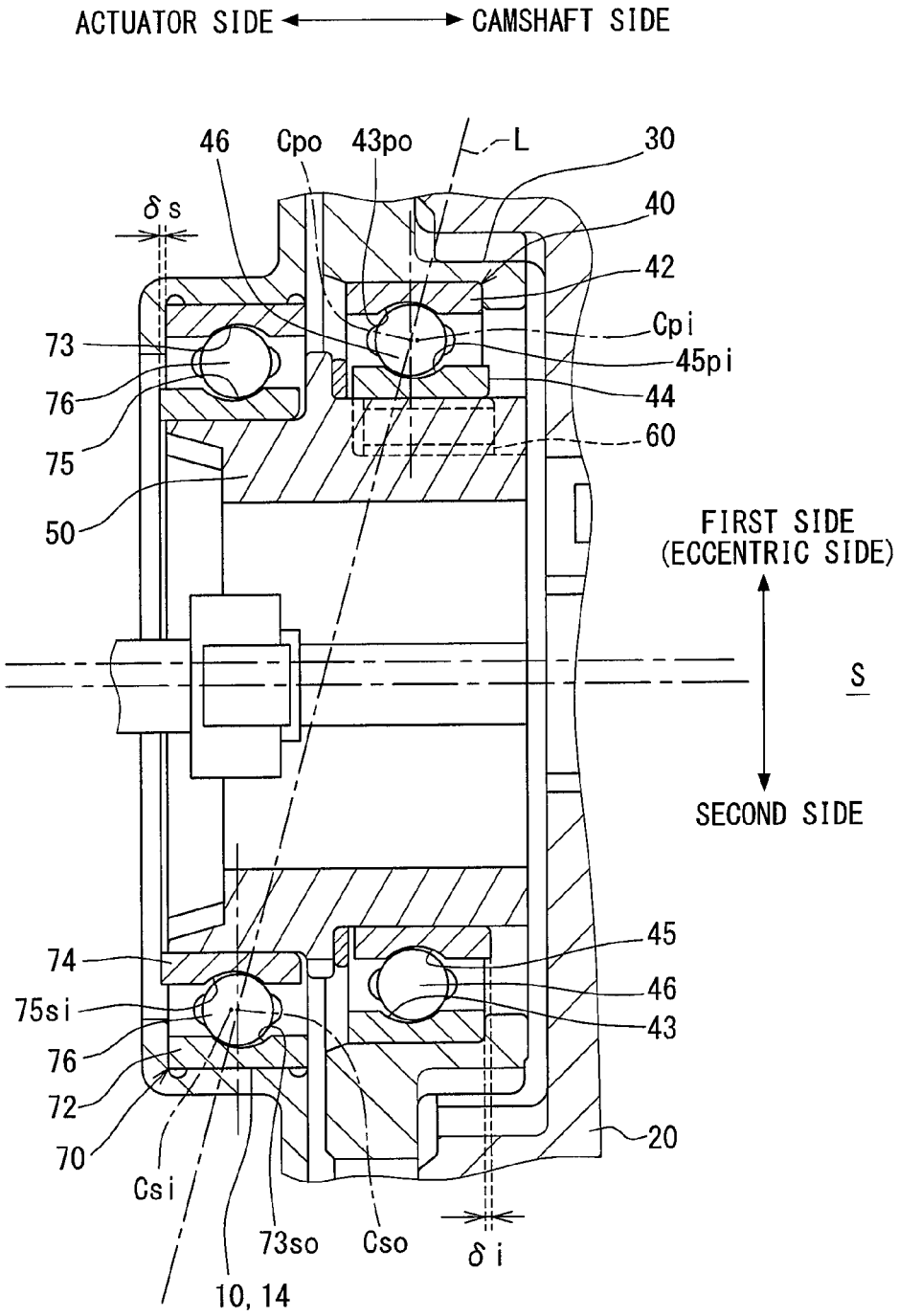
FIG. 4 is an enlarged cross-sectional view taken along a line IV-IV of FIG. 2.

Hereafter, as shown in FIGS. 1 and 4, a side adjacent to the camshaft 2 may be referred to a camshaft side, and the opposite side away from the camshaft 2 in the axial direction may be referred to an actuator side. Further, in FIG. 4, an upper side in the radial direction may be referred to a first side or eccentric side to be mentioned later, and a lower side in the radial direction may be referred to a second side opposite from the first side.

As shown in FIGS. 1-3, the planet gear 30 is arranged from the radially inner side of the peripheral wall part of the driven rotor 20 to the radially inner side of the sun-gear component 11. The planet gear 30 is made of metal, and has a stepped cylinder shape. The planet gear 30 is located eccentric to the rotors 10 and 20 in the radial direction. The planet gear 30 has a driving side planet external gear part 32 and a driven side planet external gear part 34 on the outer circumference surface of a peripheral wall part, and an addendum circle is located on an outer side of a root circle in the radial direction.

The driving side planet external gear part 32 meshes with the driving side solar internal gear part 12 on the eccentric side on which the planet gear 30 is eccentric to the rotors 10 and 20 (hereafter referred to "eccentric side" as shown in FIGS. 2, 3 and 4). The driven side planet external gear part 34 is located between the driving side planet external gear part 32 and the camshaft 2 in the axial direction, and is located at a position not overlapping with the driving side planet external gear part 32 in the radial direction. The outside diameter of the driven side planet external gear part 34 is different from that of the driving side planet external gear part 32, e.g., smaller than the outside diameter of the driving side planet external gear part 32. The number of teeth of the driven side planet external gear part 34 is set less than the number of teeth of the driving side planet external gear part 32. The driven side planet external gear part 34 meshes with the driven side solar internal gear part 24 on the eccentric side.

As shown in FIGS. 1-3, the planet bearing 40 made of metal is arranged on the radially inner side of the driving side planet external gear part 32 and the radially inner side of the driven side planet external gear part 34. The planet bearing 40 is eccentric to the rotors 10 and 20 in the radial direction. The planet bearing 40 is a single-row radial bearing in which plural spherical rolling elements 46 are arranged in one row between the planet outer wheel 42 and the planet inner wheel 44. In this embodiment, the planet bearing 40 is a single-row deep groove ball bearing. The planet outer wheel 42 is coaxially press-fitted into the planet gear 30, thereby supporting the gear 30 from the radially inner side.

The planet outer wheel 42 has an outer raceway groove 43 that is a circular groove recessed outward in the radial direction and that continuously extends in the circumferential direction. The outer raceway groove 43 has an arc shape in the cross-section that is symmetrical in the axial direction.

The planet inner wheel 44 has an inner raceway groove 45 that is a circular groove recessed inward in the radial direction and that continuously extends in the circumferential direction. The inner raceway groove 45 has an arc shape in the cross-section that is symmetrical in the axial direction.

Each of the spherical rolling elements 46 is arranged between the outer raceway groove 43 and the inner raceway groove 45 in the rolling contact state relative to the perimeter surface. The raceway groove 43, 45 is in the rolling contact with the perimeter surface of the planet spherical rolling element 46.

As shown in FIG. 1, the solar bearing 70 is made of metal and is arranged coaxially with the rotors 10 and 20 on the radially inner side of the cover component 14. The solar bearing 70 is a single-row radial bearing in which plural solar spherical rolling elements 76 are arranged in one row between the solar outer wheel 72 and the solar inner wheel 74, and is a single-row deep groove ball bearing in this embodiment. The solar outer wheel 72 is coaxially press-fitted in the cover component 14, and supports the driving rotor 10 from the radially inner side.

As shown in FIGS. 1 and 4, the solar outer wheel 72 has an outer raceway groove 73 that is a circular groove recessed outward in the radial direction and that continuously extends in the circumferential direction. The outer raceway groove 73 has an arc shape in the cross-section that is symmetrical in the axial direction.

The solar inner wheel 74 is arranged on the inner side of the solar outer wheel 72 in the radial direction, and has an inner raceway groove 75 that is a circular groove recessed inward in the radial direction and that continuously extends in the circumferential direction. The inner raceway groove 75 has an arc shape in the cross-section that is symmetrical in the axial direction. The raceway groove 73, 75 is in the rolling contact with the perimeter surface of the solar spherical rolling element 76.

As shown in FIGS. 1-3, the planet carrier 50 is made of metal, and has a cylinder shape that is partially eccentric. The planet carrier 50 is arranged on the radially inner side of the planet inner wheel 44 and the radially inner side of the solar inner wheel 74. The planet carrier 50 has an input unit 51 on the inner circumference surface of a peripheral wall part. The input unit 51 has a cylindrical surface that has a same axis as the rotors 10 and 20 and the control shaft 6. The input unit 51 has a connection slot 52 fitted with a joint 53, and the control shaft 6 is connected with the planet carrier 50 through the joint 53. The planet carrier 50 rotates integrally with the control shaft 6.

As shown in FIG. 1, the planet carrier 50 includes the solar bearing part 56 having the cylindrical surface shape arranged coaxially with the rotors 10 and 20, on the outer circumference surface of the peripheral wall part. The solar bearing part 56 is supported by the solar inner wheel 74 from the radially outer side, which is coaxially fitted from the outer side through a minute clearance. The planet carrier 50 is able to rotate relative to the driving side solar internal gear part 12.

As shown in FIGS. 1-3, the planet carrier 50 has the planet bearing part 54 on the outer circumference surface of the peripheral wall part. The planet bearing part 54 has a cylindrical surface eccentric to the rotors 10 and 20. The planet bearing part 54 is also eccentric to the solar bearing part 56 (located on the actuator side as shown in FIGS. 1 and 4), while the planet bearing part 54 is located between the solar bearing part 56 and the camshaft.

The planet bearing part 54 is supported by the planet inner wheel 44 from the radially outer side, which is coaxially fitted onto the planet bearing part 54 through a minute clearance. Under this situation, the planet gear 30 supported by the planet carrier 50 through the planet bearing 40 is able to integrally have planet movement according to the relative rotation of the planet carrier 50 relative to the driving side solar internal gear part 12.

When the planet carrier 50 is rotated relative to the driving side solar internal gear part 12, the driving side planet external gear part 32 and the driven side planet external gear part 34 respectively meshing with the driving side solar internal gear part 12 and the driven side solar internal gear part 24 integrally have planet movement.

The planet movement means a movement in which the planet carrier 50 revolves (around the sun) in the revolving direction while the planet gear 30 rotates in the own circumferential direction.

The elastic component 60 made of metal is received in a recess portion 55 opened at two positions in the circumferential direction of the planet bearing part 54. Each elastic component 60 is a board spring having U-shaped cross-section. Each elastic component 60 is interposed between the inner circumference surface of the planet inner wheel 44 and the bottom surface of the recess portion 55 recessed inward in the radial direction of the planet bearing part 54 of the planet carrier 50, and is maintained in the compressed state, such that the elastic component 60 is elastically deformed.

As shown in FIG. 4, when a definition cross-section S is defined along the radial direction to which the planet gear 30 and the planet bearing 40 are eccentric to the rotors 10 and 20 shown in FIGS. 2 and 3, the elastic components 60 are arranged at the symmetry positions about the definition cross-section S.

The total force of the restoring forces generated by the elastic components 60 acts on the planet inner wheel 44 toward the eccentric side. As a result, the elastic component 60 biases the planet gear 30 to the eccentric side through the planet bearing 40. Further, the total force of the restoring forces generated by the elastic components 60 acts on the planet carrier 50 toward the second side opposite from the eccentric side. Therefore, the elastic component 60 biases the planet carrier 50 to the second side.

The phase control unit 8 controls the rotation phase of the driven rotor 20 relative to the driving rotor 10 according to the rotation state of the control shaft 6, such that a suitable valve timing control is realized depending on the operational situation of the internal combustion engine.

Specifically, the control shaft 6 rotates with the same speed as the driving rotor 10. When the planet carrier 50 is not rotated relative to the driving side solar internal gear part 12, the external gear parts 32 and 34 of the planet gear 30 rotate with the rotors 10 and 20 without carrying out planet movement. As a result, the rotation phase is substantially not changed, and the valve timing is maintained.

When the control shaft 6 rotates with low speed or rotates in an opposite direction relative to the driving rotor 10, the planet carrier 50 rotates in the retard direction relative to the driving side solar internal gear part 12, and the driven rotor 20 rotates in the retard direction relative to the driving rotor 10, due to the planet movement of the external gear parts 32 and 34. As a result, the rotation phase is retarded, such that the valve timing is retarded.

When the control shaft 6 rotates with higher speed than the driving rotor 10, the planet carrier 50 rotates in the advance direction relative to the driving side solar internal gear part 12, and the driven rotor 20 is rotated in the advance direction relative to the driving rotor 10, due to the planet movement of the external gear parts 32 and 34. As a result, the rotation phase is advanced, such that the valve timing is advanced.

Details of the phase control unit 8 are explained.

As shown in FIG. 1, the driven rotor 20 has the thrust bearing part 26 that is defined by the axial end surface of the peripheral wall part, on the opening side. The thrust bearing part 26 has the ring plate shape. The planet gear 30 includes a connecting portion 36 having the ring plate shape. The connecting portion 36 connects the external gear parts 32 and 34 to each other in the radial direction. The thrust bearing part 26 slides in contact with the connecting portion 36 in the axial direction, such that the thrust bearing part 26 supports the planet gear 30 from the camshaft side in the axial direction.

As shown in FIG. 4, the raceway groove 43 of the planet outer wheel 42 of the planet bearing 40 is located offset to the actuator side from the raceway groove 45 of the planet inner wheel 44 in the axial direction in an area where the raceway groove 43 and the raceway groove 45 are partially overlap with each other in the radial direction. The planet outer wheel 42 and the planet inner wheel 44 have the substantially the same length in the axial direction. The planet outer wheel 42 has the raceway groove 43 at the central part in the axial direction. The planet inner wheel 44 has the raceway groove 45 at the central part in the axial direction.

The planet outer wheel 42 and the planet inner wheel 44 are arranged offset from each other by a predetermined dimension δi in the axial direction, for example, by flash ground processing. The raceway grooves 43 and 45 are also offset from each other in the axial direction by substantially same dimension as the predetermined dimension δi.

As shown in FIG. 4 representing the definition cross-section S, the planet side outer arc part 43*po* is defined in the raceway groove 43 on the eccentric side, and the planet side inner arc part 45*pi* is defined in the raceway groove 45 on the eccentric side. Then, due to the predetermined dimension δi, the raceway groove 43 can be in contact with the planet spherical rolling element 46 at the location between the camshaft and the center Cpo of the planet side outer arc part 43*po*. Moreover, due to the predetermined dimension δi, the raceway groove 45 can be in contact with the planet spherical rolling element 46 at the location away from the camshaft through the center Cpi of the planet side inner arc part 45*pi* and the center Cpo of the planet side outer arc part 43*po* in the axial direction.

FIG. 4 illustrates the state where the raceway grooves 43 and 45 are in the rolling contact with the planet spherical rolling element 46, at the location on the eccentric side in the definition cross-section S. Actually, in the definition cross-section S, depending on the situation, the raceway grooves 43 and 45 are in the rolling contact with the planet spherical rolling element 46 at a location shifted from the eccentric side location in the circumferential direction within the range of the arrangement pitch of the planet spherical rolling elements 46.

Furthermore, as shown in FIG. 4, while the raceway groove 73 of the solar outer wheel 72 and the raceway groove 75 of the solar inner wheel 74 are overlapped partially with each other in the radial direction, the raceway groove 73 of the solar outer wheel 72 is offset relative to the raceway groove 75 of the solar inner wheel 74 to the camshaft side. In the present embodiment, the solar outer wheel 72 and the solar inner wheel 74 have the substantially the same length in the axial direction. The solar outer wheel 72 has the raceway groove 73 at the central part in the axial direction. The solar inner wheel 74 has the raceway groove 75 at the central part in the axial direction. The solar outer wheel 72 and the solar inner wheel 74 are arranged offset from each other by a predetermined dimension δs in the axial direction, for example, by flash ground processing. The raceway grooves 73 and 75 are also offset from each other in the axial direction by substantially same dimension as the predetermined dimension δs.

As shown in FIG. 4 representing the definition cross-section S, the solar side outer arc part 73*so* is defined in the raceway groove 73 on the second side opposite from the eccentric side, and the solar side inner arc part 75*si* is defined in the raceway groove 75 on the second side opposite from the eccentric side. Then, due to the predetermined dimension δs, the raceway groove 73 can be in contact with the solar spherical rolling element 76 at the location away from the camshaft through the center Cso of the solar side outer arc part 73*so*. Moreover, due to the predetermined dimension δs, the raceway groove 75 can be in contact with the planet spherical rolling element 76 at the location adjacent to the camshaft in the axial direction. The contact location at which the raceway groove 75 and the planet spherical rolling element 76 are in contact with each other is between the center Csi of the solar side inner arc part 75*si* and the camshaft and is between the center Cso of the solar side outer arc part 73*so* and the camshaft.

FIG. 4 illustrates the state where the raceway grooves 73 and 75 are in the rolling contact with the solar spherical rolling element 76 on the eccentric side location in the definition cross-section S as one timing example. Actually, in the definition cross-section S, depending on the situation, the raceway grooves 73 and 75 are in the rolling contact with the solar spherical rolling element 76 at a location shifted from the eccentric side location in the circumferential direction within the range of the arrangement pitch of the solar spherical rolling elements 76.

Under the above situation, in the definition cross-section S, the imaginary straight line L is defined to connect straightly the center Cpo of the planet side outer arc part 43*po* and the center Cso of the solar side outer arc part 73*so* to each other, as shown in FIG. 4. In this embodiment, while the planet side inner arc part 45*pi* and the solar side inner arc part 75*si* are located on the imaginary straight line L, the planet side outer arc part 43*po* and the solar side outer arc part 73*so* are also located on the imaginary straight line L.

The advantages achieved in the present embodiment are explained below.

According to the present embodiment, the elastic component 60 interposed between the planet inner wheel 44 and the planet carrier 50 biases the planet carrier 50 away from the eccentric side, and biases the planet gear 30 to the eccentric side through the planet bearing 40. In the definition cross-section S along which the planet gear 30 is positioned eccentric in the radial direction, the planet side inner arc part 45*pi* on the eccentric side and the solar side inner arc part 75*si* on the opposite side opposite from the eccentric side are located on the imaginary straight line L connecting the center Cpo of the planet side outer arc part 43*po* on the eccentric side to the center Cso of the solar side outer arc part 73*so* on the opposite side.

Therefore, in the planet bearing 40 having the single row of rolling elements 46, the load caused by the elastic component 60 concentrates on the interface where the planet inner wheel 44 is in the rolling contact with the planet spherical rolling element 46, in the definition cross-section S, at the eccentric side location or a location adjacent to the eccentric side location in the circumferential direction. Further, in the solar bearing 70 having the single row of rolling elements 76, in the definition cross-section S, the load caused by the elastic component 60 concentrates at the location where the solar inner wheel 74 is in the rolling contact with the solar spherical rolling element 76, at the opposite side location or a location adjacent to the opposite side location in the circumferential direction.

Thus, the load is applied in the concentrated state along the imaginary straight line L, thereby stabilizing the posture of the planet carrier 50 and limiting the contact surface pressure to be generated at the position where the load is concentrated.

Therefore, in this embodiment, while the planet bearing 40 having the single row of rolling elements and the solar bearing 70 having the single row of rolling elements are adopted for downsizing, it is possible to improve the durability together with the downsizing, under the situation where devices attached to the internal combustion engine are further downsized in recent years.

In a comparison example, the posture of a planet carrier supported by the planet inner wheel and the solar inner wheel is unstable while adopting a single row type device to attain a downsizing. Concretely, in the comparison example, each of the solar inner wheel and the planet inner wheel is in the rolling contact with a spherical rolling element at plural places in the circumferential direction. Among the plural places, the load of an elastic component acts at much locations due to the posture change of a planet carrier. Since the contact surface pressure between the inner wheel and a spherical rolling element would increase at the much locations, the durability is lowered in the comparison example.

According to the present embodiment, the planet side outer arc part 43*po* and the solar side outer arc part 73*so* are located on the imaginary straight line L together with the planet side inner arc part 45*pi* and the solar side inner arc part 75*si*. Therefore, in the planet bearing 40 having the single row of rolling elements, the load of the elastic component 60 is concentratedly applied at the interface where the planet inner wheel 44 and the planet outer wheel 42 are in the rolling contact with the planet spherical rolling element 46, in the definition cross-section S, at the eccentric side location or a location adjacent to the eccentric side location in the circumferential direction.

Further, in the solar bearing 70 having the single row of rolling elements, the load of the elastic component 60 concentrates at the location where the solar inner wheel 74 and the solar outer wheel 72 are in the rolling contact with the solar spherical rolling element 76, in the definition cross-section S, at the opposite side location opposite from the eccentric side location or a location adjacent to the opposite side location in the circumferential direction.

Thus, the load is applied in the concentrated state on the imaginary straight line L, thereby stabilizing the posture of the planet carrier 50 and both the bearings 40 and 70, and limiting the contact surface pressure to be generated at the position where the load is concentrated. Therefore, the durability can be further raised.

Furthermore, according to the present embodiment, the planet outer wheel 42 is in the rolling contact with the planet spherical rolling element 46 at the location between the camshaft and the center Cpo of the planet side outer arc part 43*po* in the axial direction, and the planet inner wheel 44 is in the rolling contact with the planet spherical rolling element 46 at the location away from the camshaft through the center Cpo of the planet side outer arc part 43*po*. Therefore, it is easy to locate the arc parts 45*pi* and 43*po* on the imaginary straight line L in this embodiment.

Moreover, the solar outer wheel 72 is in the rolling contact with the solar spherical rolling element 76 at the location between the camshaft and the center Cso of the solar side outer arc part 73*so* in the axial direction, and the solar inner wheel 74 is in the rolling contact with the solar spherical rolling element 76 at the location away from the camshaft through the center Cso of the solar side outer arc part 73*so*. Therefore, it is easy to locate the arc parts 75*si* and 73*so* on the imaginary straight line L. Thus, the reliability of the effect improving the durability can be raised by surely stabilizing the orientations of the planet carrier 50 and both the bearings 40 and 70 and applying the load limitedly to the position where the load is concentrated.

Furthermore, according to the present embodiment, the planet outer wheel 42 is press-fitted to the planet gear 30 meshing with the internal gear part 12, 24 of the rotor 10, 20, such that the center Cpo of the planet side outer arc part 43*po* can be accurately positioned, which defines the raceway groove 43 of the planet outer wheel 42. The solar outer wheel 72 is press-fitted to the driving rotor 10 such that the center Cso of the solar side outer arc part 73*so*, which defines the raceway groove 73 of the solar outer wheel 72, can be positioned correctly.

Since each of the centers Cpo and Cso for assuming the imaginary straight line L is positioned in this way, the state where the inner arc parts 45*pi* and 75*si* are located on the imaginary straight line L and the state where the outer arc parts 43*po* and 73*so* are located on the imaginary straight line L can be maintained constantly. Thus, the reliability of the effect improving the durability can be raised by surely stabilizing the orientations of the planet carrier 50 and both the bearings 40 and 70 and applying the load limitedly to the position where the load is concentrated.

The planet gear 30 is supported by the thrust bearing part 26 of the driven rotor 20 from the camshaft side. Therefore, the planet gear 30 can be supported in the stabilized state. Accordingly, the planet carrier 50 can be supported in the stabilized state, while the planet bearing 40 is supported between the planet gear 30 and the planet carrier 50. Thus, the durability can be further improved while the inner arc part 45*pi*, 75*si* and the outer arc part 43*po*, 73*so* are located on the imaginary straight line L.

Other Embodiment

The above embodiment may be modified within a range not deviating from the scope of the present disclosure as defined by the appended claims.

Figure 5:
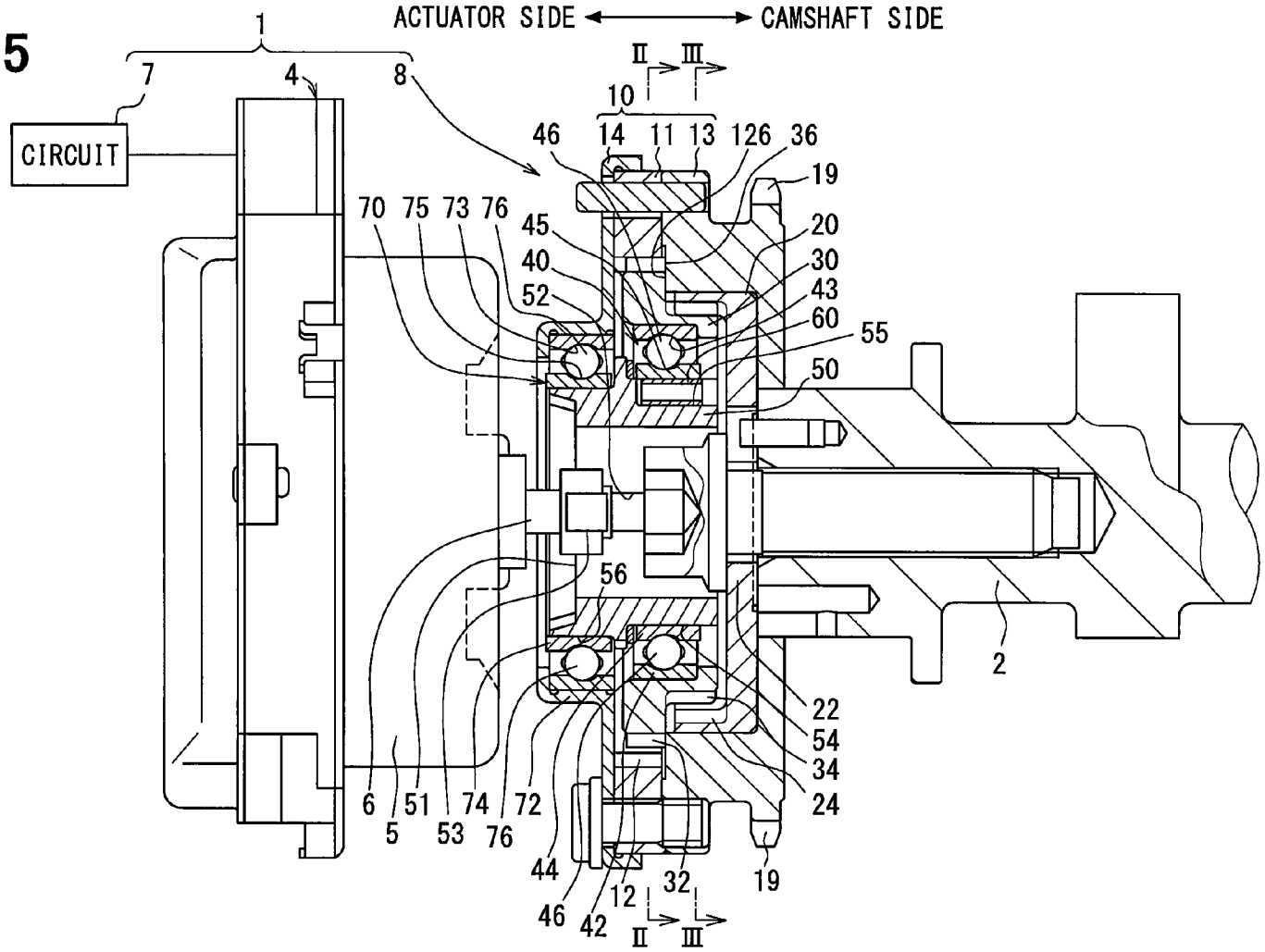
FIG. 5 is a schematic view illustrating a valve timing controller according to other embodiment.

In a first modification, as shown in FIG. 5, the thrust bearing part 126 which supports, for example, the connecting portion 36 of the planet gear 30 from the camshaft side may be formed in the sprocket component 13 of the drive rotor 10.

In a second modification, the rotors 10 and 20 may not have the thrust bearing part which supports the planet gear 30 from the camshaft side.

In a third modification, the planet outer wheel 42 coaxially fitted into the planet gear 30 with a minute clearance may support the planet gear 30 from the radially inner side.

In a fourth modification, the solar outer wheel 72 coaxially fitted into the cover component 14 with a minute clearance may support the driving rotor 10 from the radially inner side.

In a fifth modification, the planet inner wheel 44 to which the planet carrier 50 is coaxially press-fitted may support the planet carrier 50 from the radially outer side.

In a sixth modification, the solar inner wheel 74 to which the planet carrier 50 is coaxially press-fitted may support the planet carrier 50 from the radially outer side.

In a seventh modification, only the planet side inner arc part 45*pi* and the solar side inner arc part 75*si* are located on the imaginary straight line L, and the planet side outer arc part 43*po* and the solar side outer arc part 73*so* are not located on the imaginary straight line L.

Such changes and modifications are to be understood as being within the scope of the present disclosure as defined by the appended claims.

What is claimed is:

1. A valve timing controller that controls valve timing of a valve opened and closed by a camshaft by torque transferred from a crankshaft of an internal combustion engine, the valve timing controller comprising:

a driving rotor that rotates with the crankshaft, the driving rotor having a driving side solar internal gear part;

a driven rotor that rotates with the camshaft, the driven rotor having a driven side solar internal gear part that is located adjacent to the camshaft in an axial direction than the driving side solar internal gear part is;

a planet gear located on an eccentric side eccentric to the driving rotor and the driven rotor in a radial direction, the planet gear having a driving side planet external gear part meshing with the driving side solar internal gear part on the eccentric side, and a driven side planet external gear part meshing with the driven side solar internal gear part on the eccentric side at a location where the driven side planet external gear part is located adjacent to the camshaft than the driving side planet external gear part is, wherein the driving side planet external gear part and the driven side planet external gear part of the planet gear integrally carry out planet movement to control a rotation phase of the driven rotor relative to the driving rotor;

a planet bearing having a planet outer wheel that supports the planet gear from an inner side in the radial direction, a planet inner wheel located on an inner side of the planet outer wheel in the radial direction, and a single row of a plurality of planet spherical rolling elements between the planet outer wheel and the planet inner wheel;

a solar bearing having a solar outer wheel that supports the driving rotor from an inner side in the radial direction, a solar inner wheel located on an inner side of the solar outer wheel in the radial direction, and a single row of a plurality of solar spherical rolling elements between the solar outer wheel and the solar inner wheel;

a planet carrier supported by the planet inner wheel and the solar inner wheel from an outer side in the radial direction and being rotated relative to the driving side solar internal gear part such that the planet gear carries out the planet movement; and an elastic component interposed between the planet inner wheel and the planet carrier to bias the planet gear to the eccentric side through the planet bearing and to bias the planet carrier on an opposite side opposite from the eccentric side, wherein the planet gear is defined to have a definition cross-section perpendicular to the axial direction when the planet gear is located on the eccentric side in the radial direction relative to the driving rotor and the driven rotor, in the definition cross-section, the planet outer wheel has a planet side outer arc part that configures a raceway groove of the planet outer wheel on the eccentric side, the solar outer wheel has a solar side outer arc part that configures a raceway groove of the solar outer wheel on the opposite side opposite from the eccentric side, the planet inner wheel has a planet side inner arc part that configures a raceway groove of the planet inner wheel on the eccentric side, and the solar inner wheel has a solar side inner arc part that configures a raceway groove of the solar inner wheel on the opposite side opposite from the eccentric side, an imaginary straight line is defined by connecting a center of the planet side outer arc part and a center of the solar side outer arc part to each other, and the planet side inner arc part and the solar side inner arc part are located on the imaginary straight line.

2. The valve timing controller according to claim 1, wherein the planet side outer arc part and the solar side outer arc part are located on the imaginary straight line together with the planet side inner arc part and the solar side inner arc part.

3. The valve timing controller according to claim 2, wherein the planet spherical rolling elements roll in contact with the planet outer wheel at a location between the camshaft and the center of the planet side outer arc part, the planet spherical rolling elements roll in contact with the planet inner wheel at a location opposite from the camshaft through the center of the planet side outer arc part, the solar spherical rolling elements roll in contact with the solar outer wheel at a location opposite from the camshaft through the center of the solar side outer arc part, and the solar spherical rolling elements roll in contact with the solar inner wheel at a location between the camshaft and the center of the solar side outer arc part.

4. The valve timing controller according to claim 1, wherein the planet outer wheel is press-fitted into the planet gear, and the solar outer wheel is press-fitted into the driving rotor.

5. The valve timing controller according to claim 1, wherein the driving rotor or the driven rotor has a thrust bearing part that supports the planet gear from a side adjacent to the camshaft.

* * * * *